US008074555B1

(12) United States Patent
Sullivan et al.

(10) Patent No.: US 8,074,555 B1
(45) Date of Patent: Dec. 13, 2011

(54) METHODOLOGY FOR BORE SIGHT ALIGNMENT AND CORRECTING BALLISTIC AIMING POINTS USING AN OPTICAL (STROBE) TRACER

(76) Inventors: Kevin Michael Sullivan, Kennebunk, ME (US); Jacob Stefanus Budricks, Alberton (ZA)

( * ) Notice: Subject to any disclaimer, the term of this patent is extended or adjusted under 35 U.S.C. 154(b) by 317 days.

(21) Appl. No.: 12/284,639

(22) Filed: Sep. 24, 2008

(51) Int. Cl.
*F41G 3/00* (2006.01)

(52) U.S. Cl. ..... 89/41.17; 89/41.06; 89/41.19; 89/200; 89/203; 89/41.01

(58) Field of Classification Search ..... 89/41.06, 89/41.17, 41.19, 200, 203, 127, 28.2, 41.01; 356/4.01, 141.01
See application file for complete search history.

(56) References Cited

U.S. PATENT DOCUMENTS

| | | | | | |
|---|---|---|---|---|---|
| 3,757,632 | A | * | 9/1973 | Bellinger | 89/1.1 |
| 4,004,487 | A | * | 1/1977 | Eichweber | 89/1.815 |
| 4,152,969 | A | | 5/1979 | Leightner | |
| 4,333,106 | A | * | 6/1982 | Lowe | 348/142 |
| 4,577,561 | A | * | 3/1986 | Perry | 102/215 |
| 4,665,795 | A | * | 5/1987 | Carbonneau et al. | 89/41.03 |
| 4,698,489 | A | * | 10/1987 | Hickin et al. | 235/407 |
| 4,710,028 | A | * | 12/1987 | Grenier et al. | 356/620 |
| 4,885,977 | A | * | 12/1989 | Kirson et al. | 89/41.05 |
| 4,885,997 | A | * | 12/1989 | Wakahayashi | 104/172.3 |
| 5,042,743 | A | * | 8/1991 | Edwin | 244/3.11 |
| 5,467,682 | A | * | 11/1995 | Brooks | 89/41.22 |
| 5,647,559 | A | * | 7/1997 | Romer et al. | 244/3.13 |
| 5,686,690 | A | * | 11/1997 | Lougheed et al. | 89/41.17 |
| 5,708,583 | A | * | 1/1998 | Solenne et al. | 701/4 |
| 5,988,645 | A | * | 11/1999 | Downing | 273/348 |
| 6,038,955 | A | * | 3/2000 | Thiesen et al. | 89/41.17 |
| 6,260,466 | B1 | * | 7/2001 | Humphreys | 89/41.06 |
| 6,298,841 | B1 | * | 10/2001 | Cheng et al. | 124/56 |
| 6,880,467 | B1 | * | 4/2005 | Knapp | 102/513 |
| 7,174,835 | B1 | * | 2/2007 | Knapp | 102/513 |
| 7,210,392 | B2 | * | 5/2007 | Greene et al. | 89/41.03 |
| 7,239,377 | B2 | | 7/2007 | Vermillion et al. | |
| 2004/0065189 | A1 | * | 4/2004 | Margalit et al. | 89/203 |
| 2005/0034627 | A1 | * | 2/2005 | Manole et al. | 102/513 |
| 2005/0262993 | A1 | * | 12/2005 | Nurse | 89/1.11 |

FOREIGN PATENT DOCUMENTS

| | | |
|---|---|---|
| GB | 2107835 | 10/1982 |

* cited by examiner

*Primary Examiner* — J. Woodrow Eldred
*Assistant Examiner* — Jonathan C Weber
(74) *Attorney, Agent, or Firm* — Karl F. Milde, Jr.; Eckert Seamans Cherin & Mellott, LLC

(57) ABSTRACT

A method and system for improving precision and accuracy of weaponry according to which angular position information of the fire control device and optical location information of the optical signals emitted during the flight of a projectile are processed in a computer using software to calculate and provide a precise aim point for firing one or more subsequent projectiles.

12 Claims, 12 Drawing Sheets

| Time | Item |
|---|---|
| T0-o | Fire Control Displays Solution based on solution derived from algorithm (based on previous video measurement) |
| | Information recorded/measured for processing by computer algorithms. |
| T0-n | Measurement of (a) radial Azimuth/Elevation Barrel centerline and (b) elevation of barrel/fire control elevation )(if not aligned) |
| T0-n | Firing Pin Trigger pull (or hammer fall sensor) |
| T0 | Set Back/Cartridge Launch |
| Tz1 | Measurement of projectile at Position A |
| Tz2 | Measurement of projectile at Position B |
| T1 | Video Image(x1, y1) of strobe 1 and video position (xx1,yy1) |
| T2 | Video Image(x2, y2) of strobe 2 and video position (xx1,yy1) |
| T3 | Video Image(x3, y3) of strobe 3 and video position (xx1,yy1) |
| Tx | Video Image(x4, y4) of strobe x and video position (xx1,yy1) |
| Txn | Video Image(x5, y5) of strobe xn (last strobe prior to impact) and video position (xx1,yy1) |

| Time | Item |
|---|---|
| T0-o | Fire Control Displays Solution based on solution derived from algorithm (based on previous video measurement) |
| | Information recorded/measured for processing by computer algorithms. |
| T0-n | Measurement of (a) radial Azimuth/Elevation Barrel centerline and (b) elevation of barrel/fire control elevation )if not aligned) |
| T0-n | Firing Pin Trigger pull (or hammer fall sensor) |
| T0 | Set Back/Cartridge Launch |
| Tz1 | Measurement of projectile at Position A |
| Tz2 | Measurement of projectile at Position B |
| T1 | Video Image(x1, y1) of strobe 1 and video position (xx1,yy1) |
| T2 | Video Image(x2, y2) of strobe 2 and video position (xx1,yy1) |
| T3 | Video Image(x3, y3) of strobe 3 and video position (xx1,yy1) |
| Tx | Video Image(x4, y4) of strobe x and video position (xx1,yy1) |
| Txn | Video Image(x5, y5) of strobe xn (last strobe prior to impact) and video position (xx1,yy1) |

FIG. 11

METHODOLOGY FOR BORE SIGHT ALIGNMENT AND CORRECTING BALLISTIC AIMING POINTS USING AN OPTICAL (STROBE) TRACER

FIELD OF THE INVENTION

The present invention relates to weaponry systems, more specifically, it relates to a method and arrangement for improving precision and accuracy of weaponry and their fire control devices.

BACKGROUND OF THE INVENTION

There are several real time factors that influence the accuracy of weaponry and their fire control devices.

Existing fire control devices use ballistic tables and metrological sensors to calculate a predicted hit point (gunner aiming point). Also, some fire control devices allow for users to input manual drift and elevation offsets, but these offsets are generally linear offsets. Further, fire control devices often provide inaccurate aim points because a limited number of inputs are taken into consideration while calculating the aim points.

Existing wind sensing methodologies such as LIDAR and Doppler radar are too expensive to be incorporated into ground combat systems. Also, during the flight of the projectile, different wind conditions exist at different elevations, thus it is not effective to use a wind sensor at the fire control device as the wind conditions at the firing location are different from wind conditions on the in-flight projectile. Further, the trajectory of some projectiles makes it problematic to use wind sensors.

Chemical tracers have been used in ammunition for many years, but use of chemical tracers induces drag that negatively affects projectile ballistics. Further, chemical tracers do not allow precise measurement of the projectile time-location.

The U.S. Pat. No. 4,152,969 discloses a wind and target motion correction method for an airborne fire control system; however, the patent does not describe any method for correcting wind errors in ground combat systems.

The U.K. patent number GB 2,107,835 relates to a method and a device for correcting subsequent firing of a projectile from a weapon. However, the disclosed system is limited to the firing of the projectiles having a flat trajectory only, excluding its use for long range firing, and it does not take into account certain factors, such as errors due to gun jump or the like.

The U.S. Pat. No. 7,239,377 relates to a method and a device for determining a second range to a target based on data observed from a first range to the target. The method uses computer programs to calculate second range to the target using sensors such as a laser range sensor and a tilt sensor. However, practical considerations, such as atmospheric conditions, limit the accuracy of calculated solutions. Thus, there is a need to take into account real time observed data to improve the precision and accuracy of a fire control device.

In summary, there is a need for using real time data in weaponry systems to provide an improved ballistic control.

SUMMARY OF THE INVENTION

The principal object of the present invention is to improve the precision and accuracy of weaponry systems by taking into account all the factors that affect the actual flight of a projectile.

It is another object of the present invention to use a projectile with an optical emitter that emits short and intense optical signals at pre-determined time intervals to trace the path followed by the projectile. These optical emissions include but may not be restricted to light in ultraviolet, infra red and visual wavelengths.

It is another object of the present invention to improve the fire control device of the weaponry system by observing the angular position information of ammunition at known time points.

It is still another object of this invention to improve fire control solutions and allow for fire control computers to observe and calculate precise aim points and, in particular to correct errors due to (a) bore sight misalignment, (b) lot-to-lot errors, (c) occasion-to-occasion errors, (d) wind action on the projectile, and (e) several other local factors that contribute to error in fire control devices.

It is still another object of the present invention to use real time observed data to calculate new and improved fire control solutions for subsequent firing of projectiles.

It is still another object of the present invention to transmit optical signals in short form, thereby minimizing power consumption of reserve batteries and field generators used in the projectile fuzes.

It is still another object of the present invention to transmit optical signals in discrete bursts, thereby avoiding continuous processing of sensor inputs by processors of the computer disposed in the fire control device.

In the present invention, the weapon's ammunition tracer strobe, which is normally located with the fuze in the projectile ogive, provides time-location data and the fire control device observes the angular position of the projectile.

These objects, as well as still further objects which will become apparent from the discussion that follows, are achieved, in accordance with the present invention, by a method including the following steps:

(a) measuring angular position information between the weapon's barrel centerline and a fire control device;
(b) use of one or more sensors to identify possible parameters affecting the flight of the projectile;
(c) generating optical signals at predetermined time intervals using an optical emitter disposed in a housing of a projectile;
(d) receiving the optical signals generated in step (c) using an optical detector attached to the fire control device and measuring angular shift of the fire control device using sensors to detect gun jump or other post firing movement;
(e) processing the optical signals in a video processor for identifying optical location information of the flight of the projectile;
(f) using the angular position information, the aforesaid parameters, the angular shift and the optical location information to calculate a precise aim point, wherein the said calculation is carried out using software in a computer; and
(g) identifying the precise aim point to a user for firing one or more subsequent projectiles.

The foregoing and other objects, features and advantages of the invention will be apparent from the following more particular description of the invention, as illustrated in the accompanying drawings.

BRIEF DESCRIPTION OF DRAWINGS

FIG. 3(*b*) illustrates the transmission of optical signals.

FIG. 4(*b*) illustrates the axis of rotation of the projectile for ballistic trajectory.

FIG. 4(*c*) illustrates a ballistic profile of an in-flight projectile.

FIG. 11 shows a table for a sequence of measurements at different points of time to calculate an improved fire control solution.

DETAILED DESCRIPTION OF THE PREFERRED EMBODIMENTS

Embodiments of the present invention provide a method and arrangement for bore sight alignment and correcting ballistic aiming points using an optical strobe tracer. In the description of the present invention, numerous specific details are provided, such as examples of components and/or mechanisms, to provide a thorough understanding of the various embodiments of the present invention. One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Figure 1:
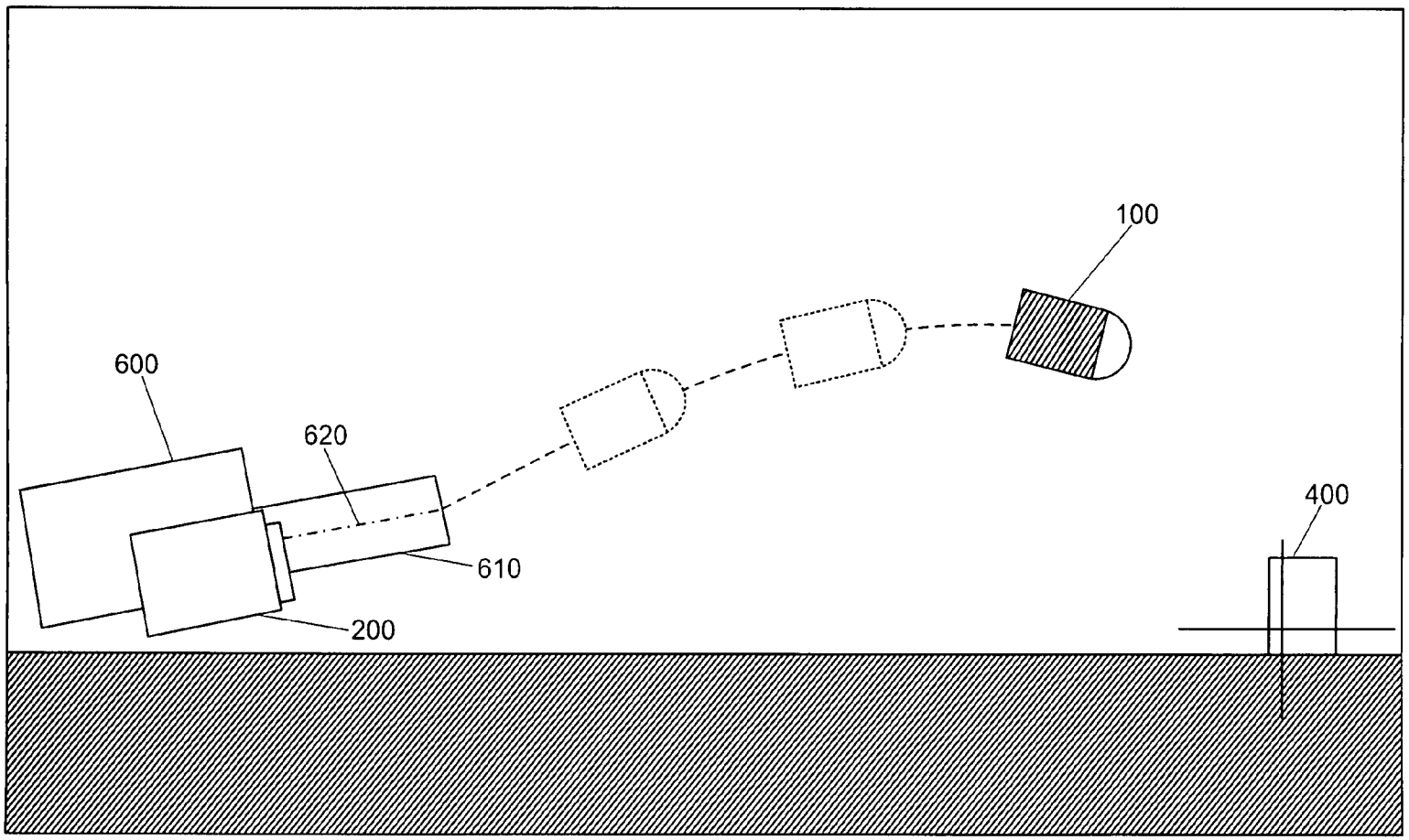
FIG. 1 illustrates a weaponry system for firing a projectile.

FIG. 1 illustrates a weaponry system comprising one or more projectiles 100, a weapon 600 and a fire control device 200. The weapon 600 can be a gun, launcher, firearms, cannons, rocket pods, aircraft and the like.

The projectile 100 aimed at a target 400 is fired through a barrel 610 of the weapon 600 in response to a shoot command generated manually by a user. The shoot command can also be generated automatically by the fire control device 200 of the weaponry.

Figure 2:
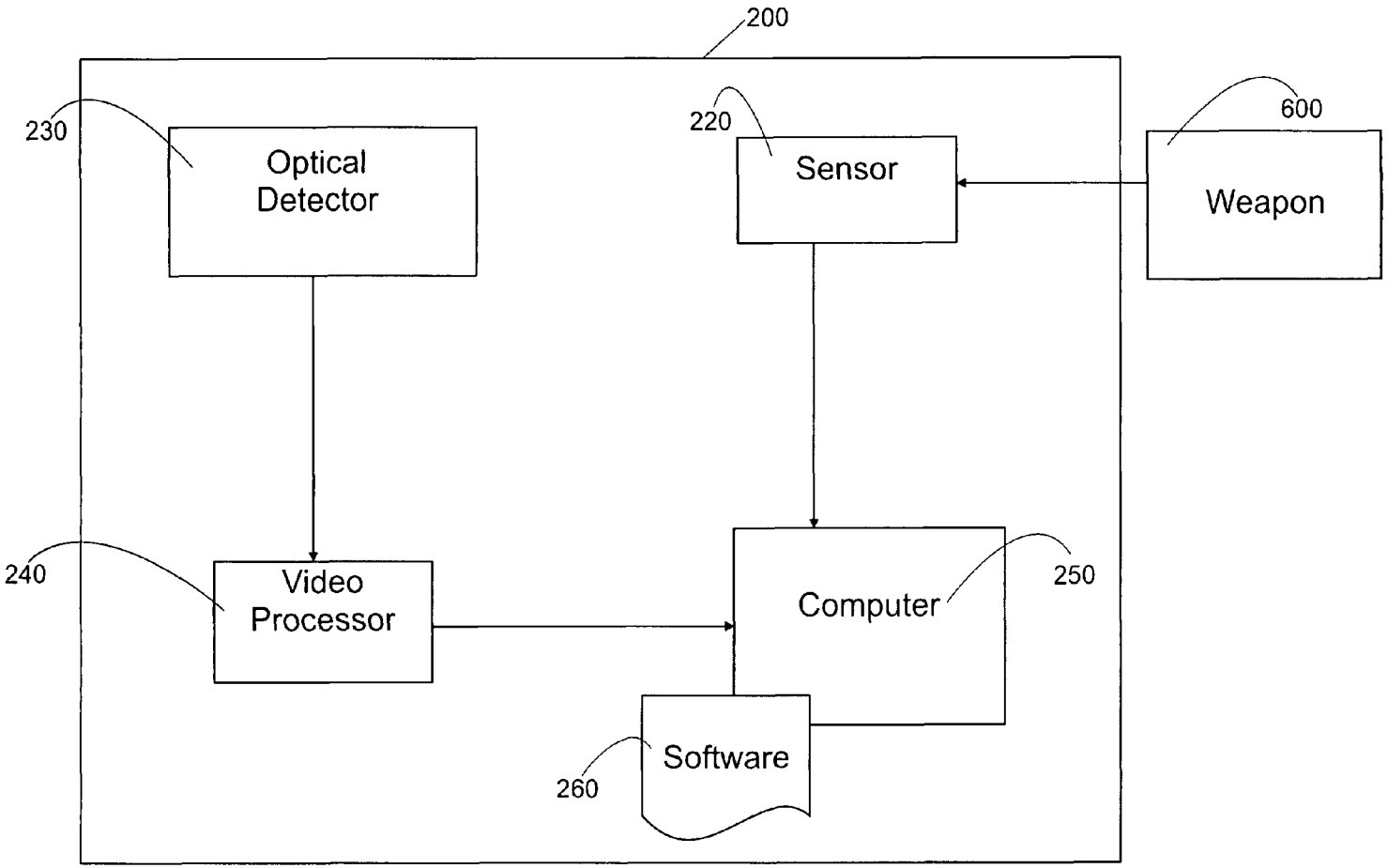
FIG. 2 illustrates different components of a fire control device.

FIG. 2 illustrates the weapon 600 and the fire control device 200 comprising one or more sensors 220, one or more optical detectors 230, one or more video processors 240 and a computer 250 having a software 260.

The sensors 220 are used in the present invention for identifying signals or any other parameters. Such sensors can be of various types, for example, position sensors, sensors for gun elevation, optical sensors and the like.

The optical detector 230 can be a camera or any image capturing device, for example video camera, infrared camera or the like.

The fire control device 200 measures angular position information of the weapon 600, when the weapon 600 fires the projectile 100 aimed at the target 400. The angular position information includes radial azimuth/elevation barrel centerline 620 and elevation of barrel/fire control elevation, wherein the angular position information is measured by using the sensors 220 and the information is recorded by the computer 250.

Figure 3A:
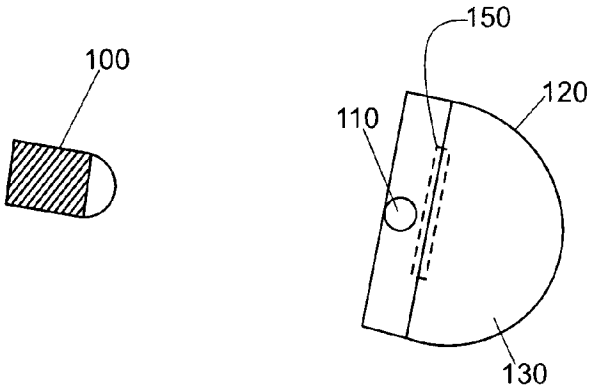
FIG. 3(*a*) illustrates the projectile and an exploded view of its nose.
Figure 3B:
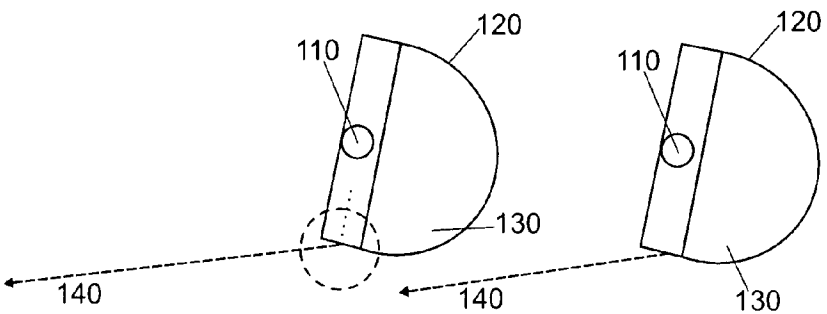

FIG. 3(*a*) illustrates the projectile 100 and an exploded view of the nose 130 of the projectile 100. The projectile 100 comprises an optical strobe emitter 110, which is disposed in a translucent housing 120 of the projectile 100. Optical emitter 110 of the projectile 100 is a light generating source which can be a light emitting diode, laser or the like.

In one embodiment of the present invention, an electronic fuze 150 is disposed in the projectile 100. The fuze 150 is programmed to relay precise position information of the projectile 100 to the fire control device 200.

FIG. 3(*b*) illustrates the transmission of optical signals 140 from the optical emitter 110 of the projectile 100 in the direction of the fire control device 200, these optical signals 140 being generated at pre-determined time intervals during flight of the projectile 100. A 360 degree refractive lens (not shown in the figure) is disposed in the translucent housing 120 of the projectile 100. This lens allows optimized transmission of optical signals 140 from the emitter 110 in the direction of the fire control device 200.

The optical emitter 110 emits optical signals 140 of high intensity and for very short period of time during the flight of the projectile 100. Various types of optical emissions such as emissions in ultraviolet, infra red and visual spectrum of various frequencies and intensities can also be used without altering the scope of the invention.

In another embodiment of the present invention, it is possible to code the emissions of the optical signal 140 with a time code pulse.

In still another embodiment of the present invention, the optical emission (signal) 140 may include embedded signals corresponding to the precise time function.

Figure 4A:
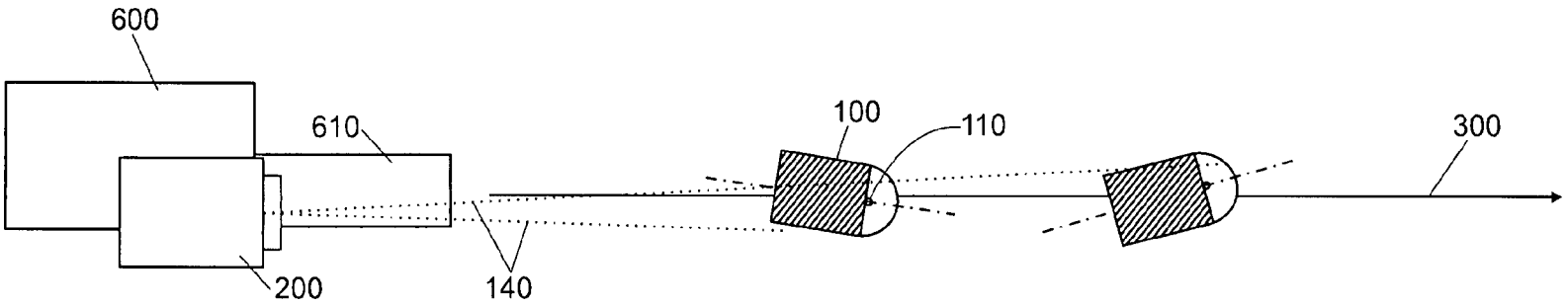
FIG. 4(*a*) illustrates an induced yaw in the projectile in a flat trajectory.
Figure 4B:
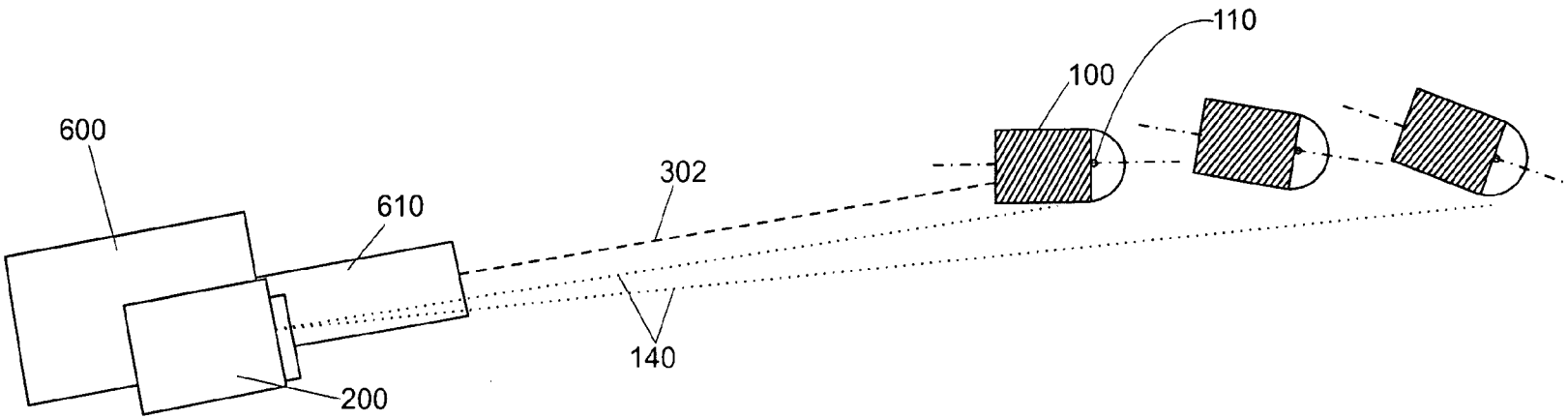
Figure 4C:
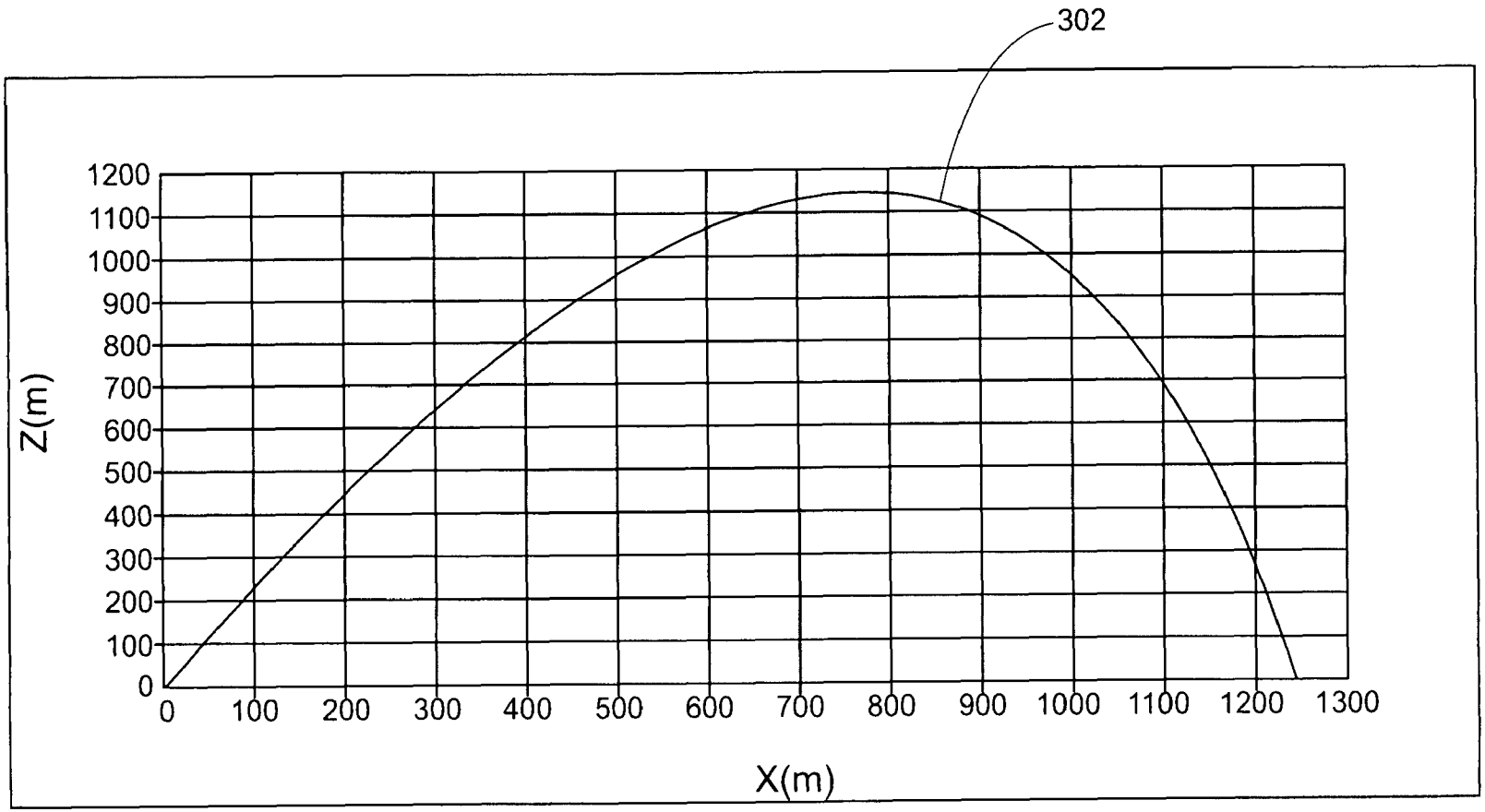

FIG. 4(*a*) and FIG. 4(*b*) illustrate an arrangement for effectively transmitting the optical signal 140 generated from the optical emitter 110 toward the fire control device 200 during the flight of the projectile 100.

FIG. 4(*a*) illustrates firing of the projectile 100 aimed at a short range target (not shown in the figure). The path followed by the projectile 100 is relatively flat 300. Yaw enables the projectile 100 to rotate about its vertical axis so as to optimally position the projectile 100 to emit optical signals 140 more effectively in the direction of the fire control device 200. This yaw can be induced on projectiles 100 through a number of well known mechanical factors.

As shown in FIG. 4(*b*), the projectile 100 is fired at an angle for a long range target (not shown in the figure). The axis of the in-flight projectile 100 changes relative to the position of the fire control device 200; thereby allowing the emitter 110 to transmit optical signals 140 in the direction of the fire control device 200. The path followed by the projectile 100 is ballistic 302 as shown in FIG. 4(*c*). This figure shows the ballistic profile of 40 mm×53 HV grenade by using a PRODAS (PROjectile Design and Analysis System) cross plot.

Figure 5:
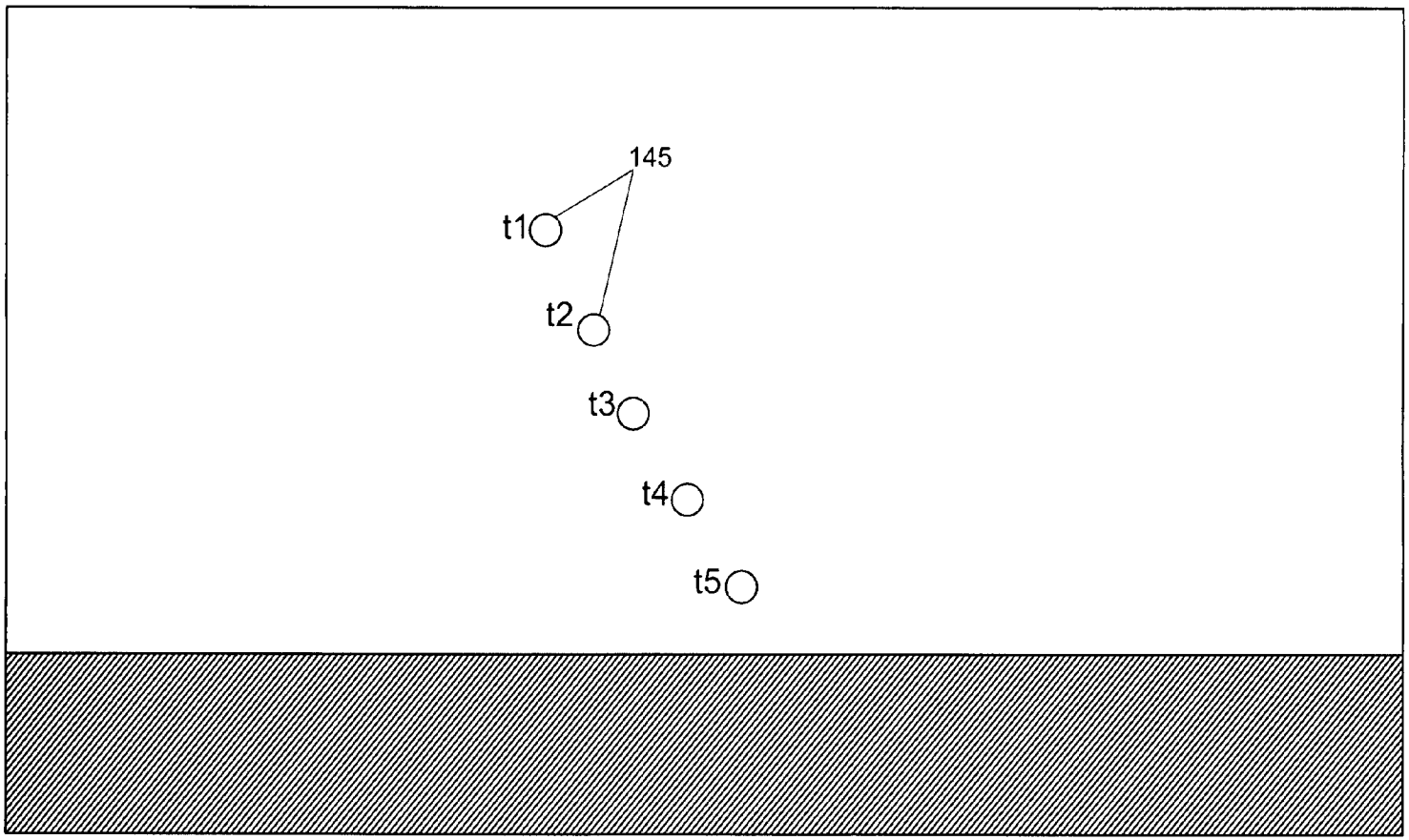
FIG. 5 illustrates an optical strobe images of the projectile at pre-determined time intervals (viewed from the fire control or position of the fire control).

The optical signals 140 generated by the optical emitter 110 of the projectile 100 are detected by the fire control device 200 using the optical detector 230. The optical detector 230 of the fire control device 200 collects the optical emissions (signals) 140 at the pre-determined time intervals after firing. The optical signals 140 emitted by the optical emitter 110 of the projectile 100 at the discrete time intervals (t1, t2, t3, t4 and t5) are received by the optical detector 230 and digitally recorded as strobe images 145, as illustrated in FIG. 5.

Figure 6:
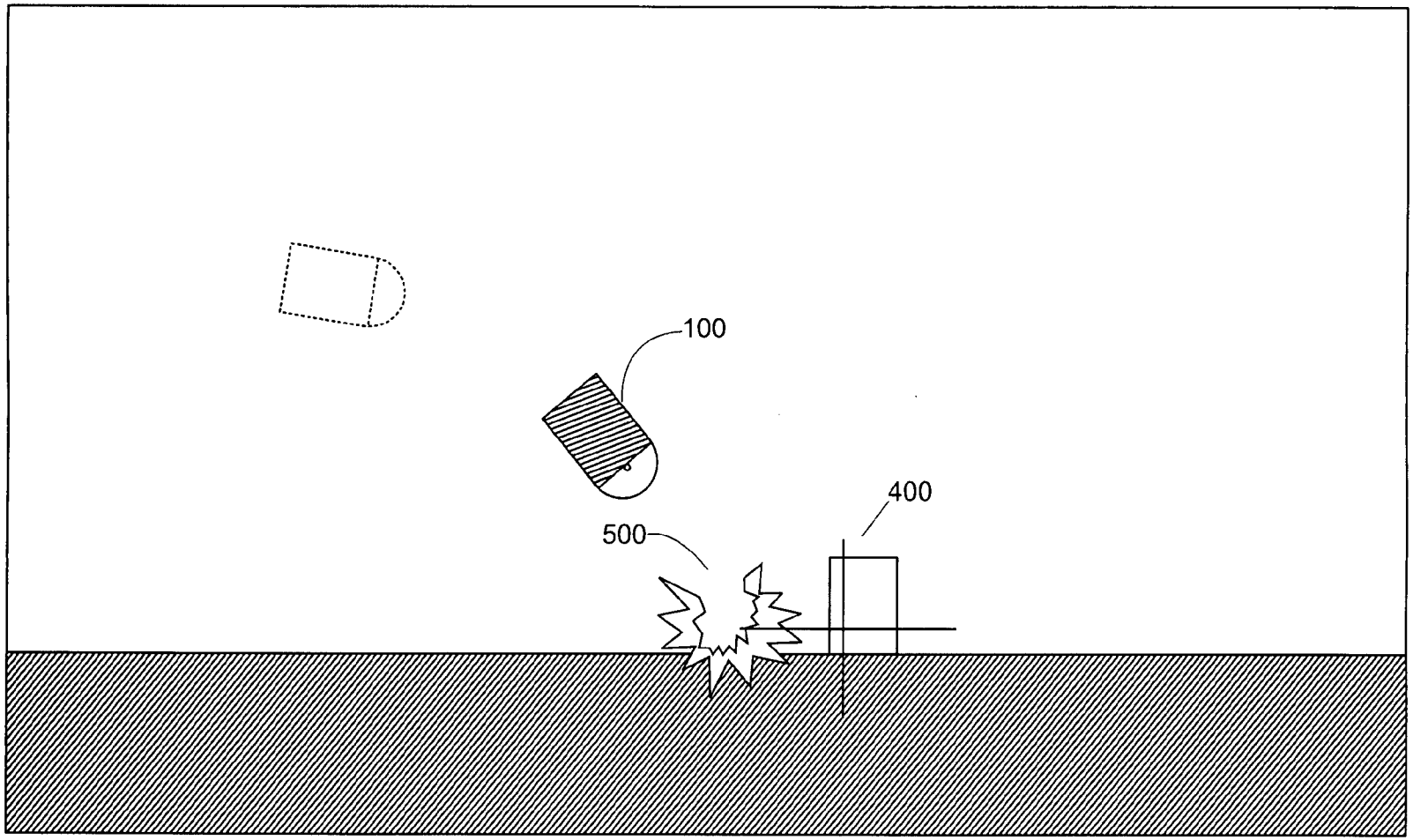
FIG. 6 illustrates an actual hit point of the projectile fired without any correction.

FIG. 6 illustrates an actual hit point 500 of the fired projectile 100 and the intended target 400. The projectile 100 misses the intended target 400 because of some real time errors such as, for example, occasion to occasion errors, lot-to-lot errors, bore sight misalignment and errors resulting from varying environmental conditions such as wind direction, wind speed and the like. The present invention facilitates in correcting these errors for firing subsequent projectiles 100 to hit the intended target 400 by processing the real time observed data.

The digitally recorded strobe images 145 are processed by the video (or image) processor 240 of the fire control device 200 to identify actual drift and drop of the fired projectile 100 as observed from the fire control device 200.

Figure 7:
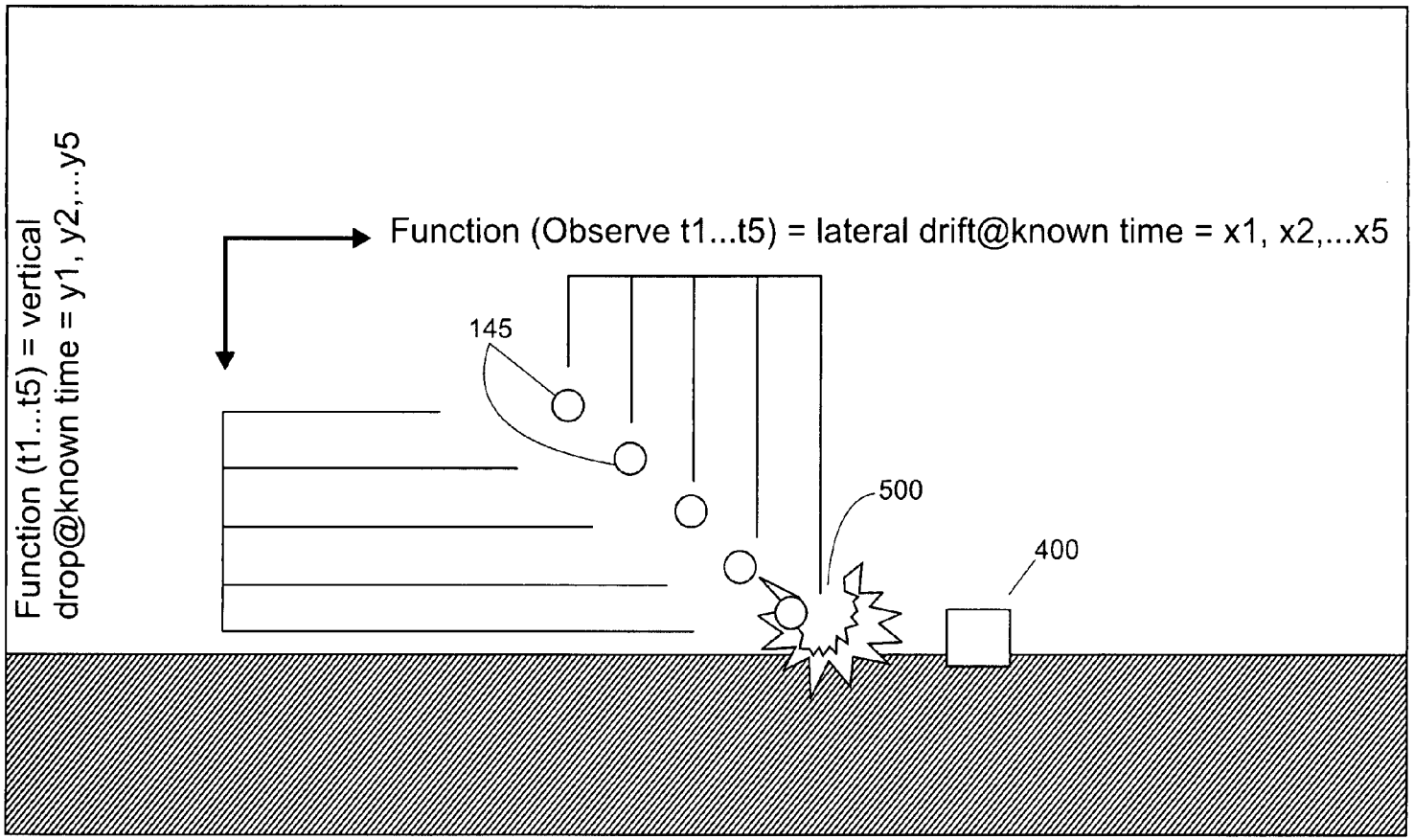
FIG. 7 illustrates a lateral drift and vertical drop of the fired projectile.

The video processor 240 of the fire control device 200 detects the strobe images 145 at pre-determined time intervals (t1, t2, t3, t4 and t5) after firing of the projectile 100. Video processing software of the video processor 240 distinguishes the optical signal 140 from the collected strobe image 145 and measures angular changes that are used to calculate optical location information, wherein the optical location information comprises lateral drift (i.e. x1, x2, x3, x4 and x5) and vertical drop (i.e. y1, y2, y3, y4 and y5) of the projectile at the predetermined time intervals (i.e. t1, t2, t3, t4 and t5) as illustrated in FIG. 7.

Figure 8:
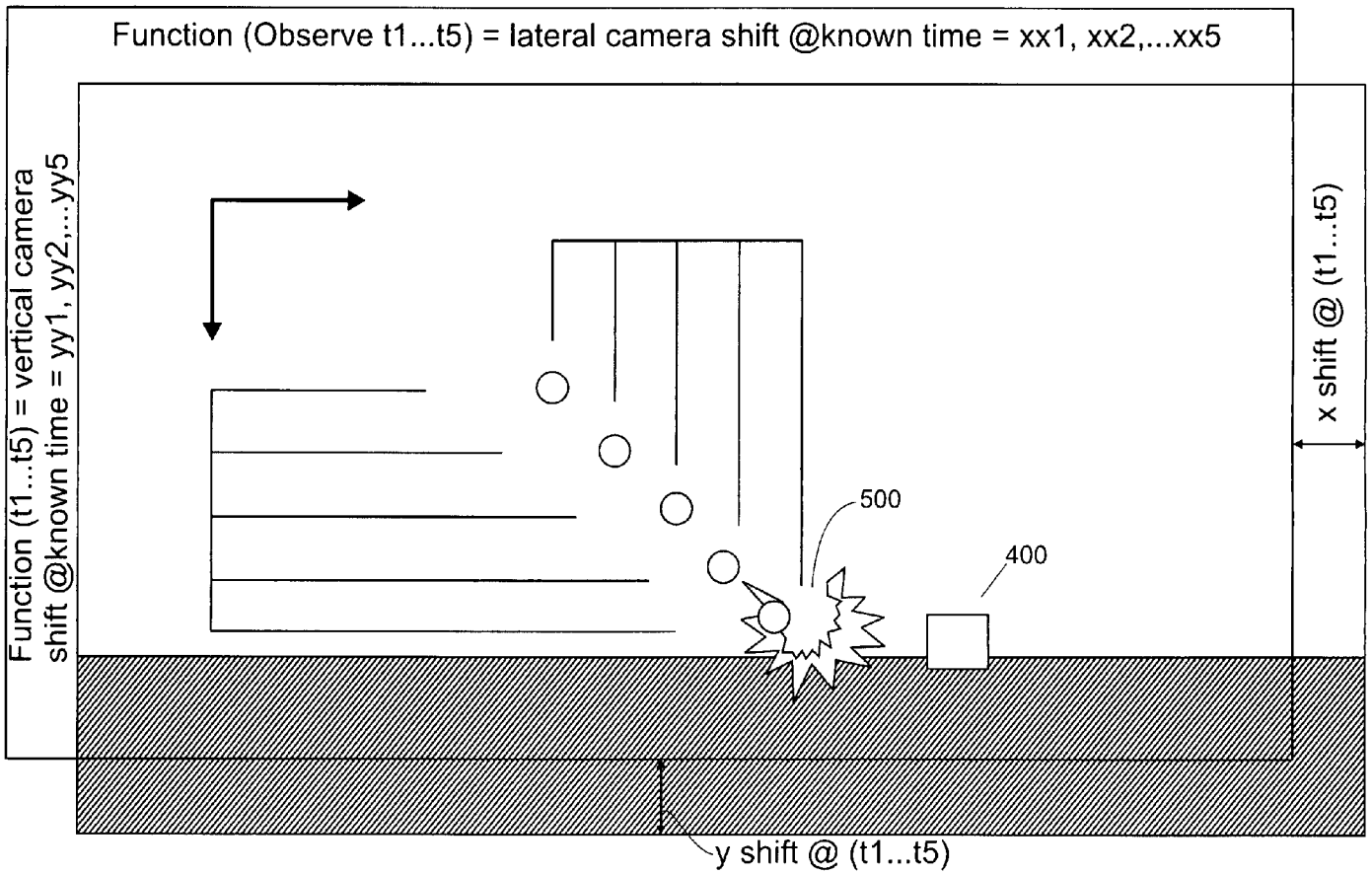
FIG. 8 illustrates a lateral camera shift and vertical camera shift caused by gun jump at pre-determined time intervals.

At each pre-determined time interval (t1, t2, t3, t4 and t5), the fire control device 200 also records angular shift in the optical detector 230 using one or more sensors 220 disposed in the fire control device 200. This angular shift is determined by measuring shift in the horizontal (x) direction (i.e. xx1, xx2, xx3, xx4 and xx5) and shift in the vertical (y) direction (i.e. yy1, yy2, yy3, yy4 and yy5) of the optical detector 230 at the pre-determined time intervals (t1, t2, t3, t4 and t5), as illustrated in FIG. 8. The angular shift occurs due to gun jump or other post firing movements. "Gun jump" refers to the movement of the fire control device 200 or weapon 600 at the time of firing the projectile 100. Errors due to gun jump can be solved in a number of ways such as, but not restricted to using software algorithms that detect the image shift or by using sensitive accelerometers or measuring equipment that detects relative change in position of the sensors.

Figure 9:
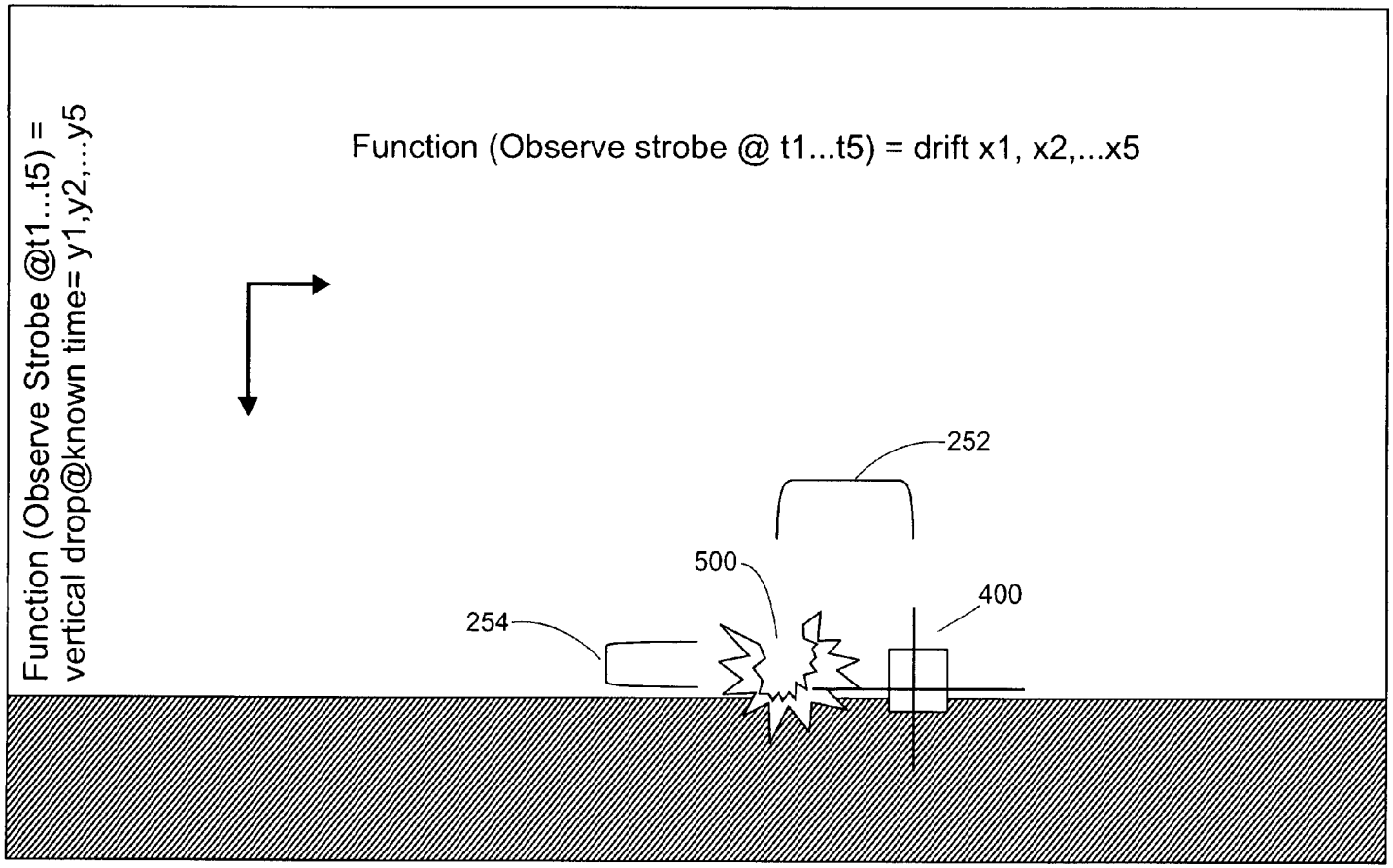
FIG. 9 illustrates a lateral correction factor and vertical correction factor.

The angular shift information along with the observed actual lateral drift and vertical drop data are provided to the computer 250 of the fire control device 200. The computer 250 uses this information and the angular position information of the weapon 600, recorded at the time of firing the projectile 100, with software 260 to calculate lateral correction 252 and vertical correction 254 as illustrated in FIG. 9. The lateral correction 252 is a function of the total observed lateral drift in the x coordinate (i.e., sum of the observed lateral drift x1, x2, x3, x4 and x5) and vertical correction 254 is a function of the total observed vertical drop in the y coordinate sum of the observed vertical drop y1, y2, y3, y4 and y5) of the initially fired projectile 100 that misses the target 400. These corrections are used to calculate a new and improved fire control solution for subsequent firing. This solution takes into account the errors resulting from factors such as wind speed, wind direction or the like.

In one embodiment of the present invention, the fire control device 200 resets subsequent fire control solutions by using the actual observed drift and drop of the improved fire control solution, thereby providing a precise aim point for firing the subsequent projectiles 100.

In another embodiment of the present invention, the fire control device 200 establishes a correction factor to modify the calculated fire control solution, thereby providing a more precise aim point for firing a subsequent projectile 100.

Figure 10:
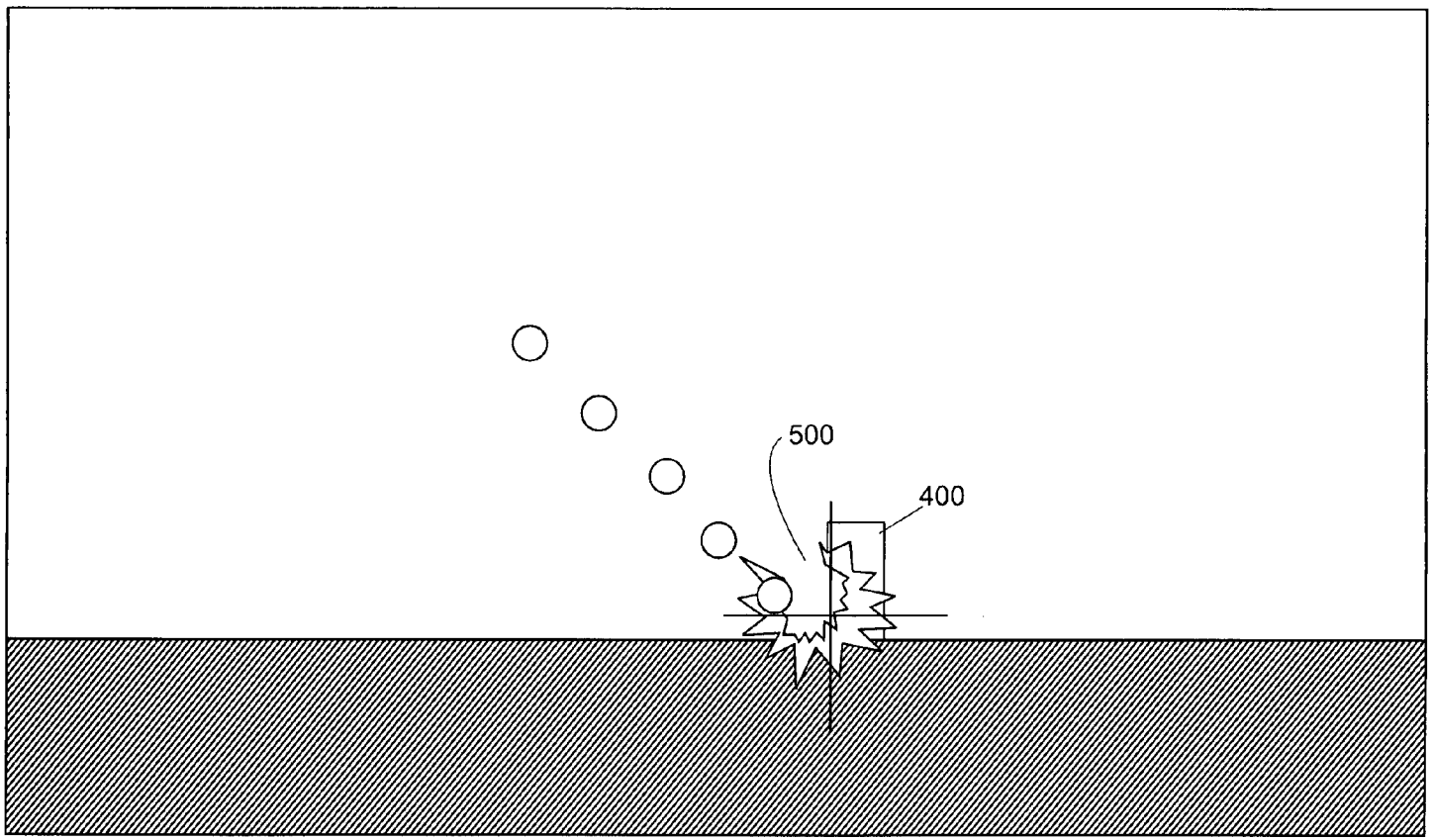
FIG. 10 illustrates a subsequently fired projectile hitting the intended target.

The fire control device 200 uses the new and improved fire control solution to adjust the azimuth and elevation of aim point of the weapon 600 for firing subsequent projectiles 100, so that they hit the intended target 400 as illustrated in FIG. 10. Adjustment in azimuth corresponds to angle adjustment of the weapon 600 in the horizontal (left or right) direction to hit the intended target 400. Adjustment in elevation corresponds to angle adjustment of the weapon 600 in the vertical (up and down) direction to hit the intended target 400. These adjustments provide a precise aim point which is identified to the user for firing subsequent projectiles 100.

Further, when subsequent projectiles 100 are fired, the fire control device 200 repeatedly measures the adjustments in the azimuth and elevation of the aim point and uses commonly known mathematical algorithms to improve the precision and accuracy of the corrected aim point by repositioning the weapon 600.

FIG. 11 identifies various measurement parameters at different points of time during the flight of the projectile. Further, the measurements allow for optional measurement of muzzle velocity variation if needed.

The variables that may be used for calculating the improved fire control solution are described below.

T0-*o*: Time duration that fire control solutions are displayed and the weapon is physically positioned (aimed).

T0-*n*: Time when operator initiates firing.

T0: Moment ammunition is fired (set-back).

z1: Position of $1^{st}$ time measurement (Position A barrel mouth).

z2: Position at $2^{nd}$ time measurement (Position B Tz2–Tz1=Time/known distance=Muzzle Velocity)

x: Horizontal position.

y: Vertical Position.

Thus, the weaponry of the invention uses real time data and observations to calculate precise aim point solutions interrupting that help in removing errors; for example, errors resulting from varying environmental conditions such as wind direction, wind speed and the like, occasion-to-occasion errors, lot-to-lot errors, bore sight misalignment and the like.

While embodiments of the present invention have been illustrated and described, it will be clear that the present invention is not limited to these embodiments only. Numerous modifications, changes, variations, substitutions and equivalents will be apparent to those skilled in the art, without departing from the spirit and scope of the present invention, as described in the claims.

What is claimed is:

1. An improved weaponry system comprising:

(a) a projectile having a housing, an optical emitter, disposed in the housing, for producing optical signals at pre-determined time intervals following firing of the projectile;

(b) a weapon for firing said projectile;

(c) a fire control device coupled to said weapon and comprising:

i. one or more sensors for measuring angular shift caused by gun jump;

ii. one or more sensors for measuring angular position information; and iii. an optical detector for receiving said optical signals;

(d) a video processor for processing said optical signals to calculate optical location information comprising lateral drift and vertical drop of the projectile at predetermined times (T1, T2, T3 . . . ) following firing of the projectile (at time T0); and (e) a computer having software which identifies a precise aim point for firing subsequent projectiles by determining parameters, said parameters comprising:

i. said angular shift;

ii. said angular position information; and iii. said optical location information;

wherein the optical signals produced at the pre-determined time intervals (at times T1, T2, T3 . . . ) following firing of the projectile (at time T0) have a time code pulse corresponding to the precise time with respect to time T0, thereby to distinguish the projectile, which was fired at time T0, from any other projectiles viewed by the video processor; and wherein said sensors measure angular shift of the optical detector in the horizontal direction and vertical direction at the predetermined time intervals (T1, T2, T3 . . . ), thereby to correct for errors due to gun jump.

2. The system according to claim 1, wherein said projectile further comprises a fuze which is programmed to relay position information of the projectile to the fire control device.

3. The system according to claim 2, wherein said fuze is an electronic time fuze.

4. The system according to claim 1, wherein said optical emitter is light emitting diode.

5. The system according to claim 1, wherein said optical emitter emits said optical signals at discrete frequencies in the UV, visual or IR spectrums.

6. The system according to claim 1, wherein said video processor is attached to said fire control device.

7. The system according to claim 1, wherein said video processor processes strobe image data collected by said optical detector.

8. The system according to claim 7, wherein said optical detector is a camera.

9. The system according to claim 1, wherein said computer is attached to said fire control device.

10. The system according to claim 1, wherein the optical emitter includes a 360 degree lens, disposed in the housing, for transmitting the optical signals in the direction of the fire control device.

11. The system according to claim 10, wherein said lens is refractive.

12. The system according to claim 10, wherein said housing includes a translucent portion for the passage of said optical signals.

* * * * *